US012617588B1

(12) United States Patent
Reynolds

(10) Patent No.: US 12,617,588 B1
(45) Date of Patent: May 5, 2026

(54) ADAPTIVE DIAMETER SEALING MECHANISM

(71) Applicant: Robert Reynolds, Mount Juliet, TN (US)

(72) Inventor: Robert Reynolds, Mount Juliet, TN (US)

( * ) Notice: Subject to any disclaimer, the term of this patent is extended or adjusted under 35 U.S.C. 154(b) by 0 days.

(21) Appl. No.: 19/391,028

(22) Filed: Nov. 17, 2025

(51) Int. Cl.
*B65D 43/02* (2006.01)
*A47G 19/22* (2006.01)

(52) U.S. Cl.
CPC ..... *B65D 43/022* (2013.01); *A47G 19/2272* (2013.01); *B65D 2543/00046* (2013.01); *B65D 2543/00092* (2013.01); *B65D 2543/00231* (2013.01); *B65D 2543/00296* (2013.01); *B65D 2543/00518* (2013.01); *B65D 2543/00546* (2013.01); *B65D 2543/00972* (2013.01)

(58) Field of Classification Search
CPC ..... B65D 43/022; B65D 2543/00046; B65D 2543/00092; B65D 2543/00231; B65D 2543/00296; B65D 2543/00518; B65D 2543/00546; B65D 2543/00972; B65D 39/12; A47G 19/2272
USPC ..... 220/234, 235, 323, 801; 215/360, 364; 138/90
See application file for complete search history.

(56) References Cited

U.S. PATENT DOCUMENTS 299,676 A * 6/1884 Poland ..... B65D 39/12 215/361
2,214,732 A * 9/1940 Kraft ..... B65D 39/12 160/183
3,550,636 A * 12/1970 Hearne ..... F16L 55/132 220/235
6,439,415 B1 * 8/2002 Salim ..... B01J 3/03 220/817
9,455,169 B2 * 9/2016 Chou ..... H10P 72/1924
10,822,146 B2 * 11/2020 Stuart ..... A45D 33/006
12,258,184 B2 * 3/2025 Paxson ..... B65D 45/32
2015/0210445 A1 * 7/2015 Melinger ..... B65D 39/12 215/277
2018/0242712 A1 * 8/2018 Salciarini ..... A45D 33/003

* cited by examiner

*Primary Examiner* — James N Smalley

(57) ABSTRACT

A diameter-adaptive sealing mechanism includes a central actuator gear, multiple pivot-linked actuator subassemblies, and a deformable ring. Rotation of the actuator causes synchronized outward motion of the actuator subassemblies, expanding the deformable ring to engage an interior vessel wall and create a seal. Reverse rotation returns the deformable ring toward a neutral diameter. The mechanism supports manual or mechanical rotation and is suitable for applications such as adaptive tumbler lids and industrial sealing systems.

Reference Numerals
100 Actuator subassembly
110 Main pivot
115 Secondary pivot
120 Toothed sector
130 Curved arm
140a-140d Actuator subassemblies (circumferential set)
200 Mechanism assembly
210 Central actuator
300 Installed configuration
310 Deformable ring
320 Channel
400 Housing
410 Upper housing plate
420 Lower housing plate
430 Upper mechanism plate
440 Lower mechanism plate
500 Vessel (Continued)

600 Central support member (optionally defining a through-passage)

16 Claims, 7 Drawing Sheets

ADAPTIVE DIAMETER SEALING MECHANISM

CROSS-REFERENCE TO RELATED APPLICATIONS

None. No prior provisional or foreign filing is claimed.

BACKGROUND OF THE INVENTION

Field of the Invention

The invention relates to mechanically actuated sealing systems that adjust to engage the interior wall of a container. More particularly, it concerns a gear-driven, radially adaptive mechanism for creating uniform circumferential sealing pressure within vessels such as tumblers, cups, and industrial containers.

Description of Related Art

Conventional container lids and adapters are typically fixed in diameter or rely solely on elastomeric deformation for fit Such approaches provide limited sealing consistency, uneven contact pressure, and restricted size range. Existing designs lack a mechanism that translates a central rotational motion into synchronous radial expansion around a full circumference.

Various adjustable or flexible sealing mechanisms are known, including threaded compression rings, cam-driven expanders, and elastic gaskets. However, these lack a central actuator that simultaneously drives multiple pivoting subassemblies to achieve synchronized radial expansion. There remains a need for a compact, mechanically actuated system that uniformly expands a deformable ring to fit containers of different diameters with a controlled seal.

SUMMARY OF THE INVENTION

The invention provides an adaptive-diameter sealing mechanism that converts rotational motion into coordinated radial expansion. A central actuator gear drives multiple toothed sectors arranged circumferentially; each sector is linked to a curved arm pivoted to the housing. As the actuator rotates, the arms move outward in synchrony to expand a deformable ring positioned around the perimeter. When rotation is reversed, the deformable ring returns to its neutral state.

The mechanism can achieve a radial expansion ratio on the order of approximately 30-40 percent, offering a controlled, reusable, and uniform seal suitable for consumer and industrial applications. Actuation is preferably manual via a dial on an upper lid, but any suitable rotational drive may be used. The mechanism is well suited for integration into universal-fit tumbler lids and other vessels requiring adjustable-diameter sealing. In certain embodiments, a user-actuable dial or other actuator interface is provided together with a portion of the housing, lid, or other stationary structure that can be grasped by a user to resist rotation of the mechanism or vessel while the actuator is rotated.

DETAILED DESCRIPTION OF THE INVENTION

Figure 1:
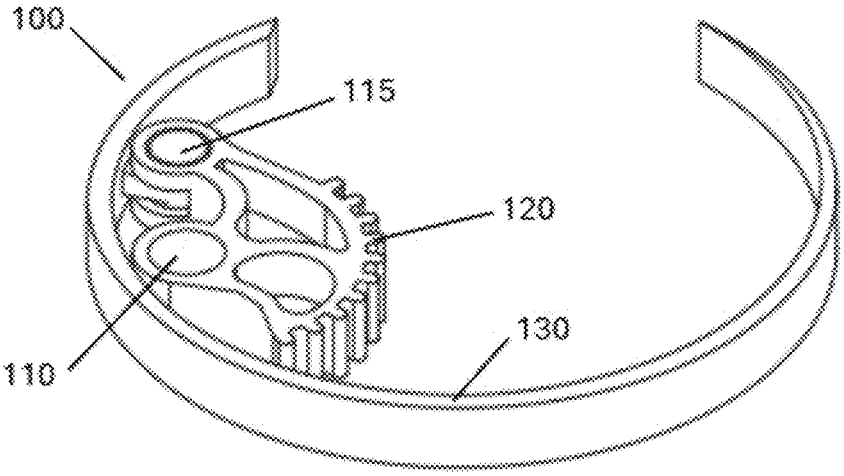
FIG. 1 is a perspective view of an actuator subassembly (100) consisting of a toothed arm or sector (120) with a primary pivot point or main pivot (110), a secondary pivot (115), and a curved flexible arm (130).
Figure 2:
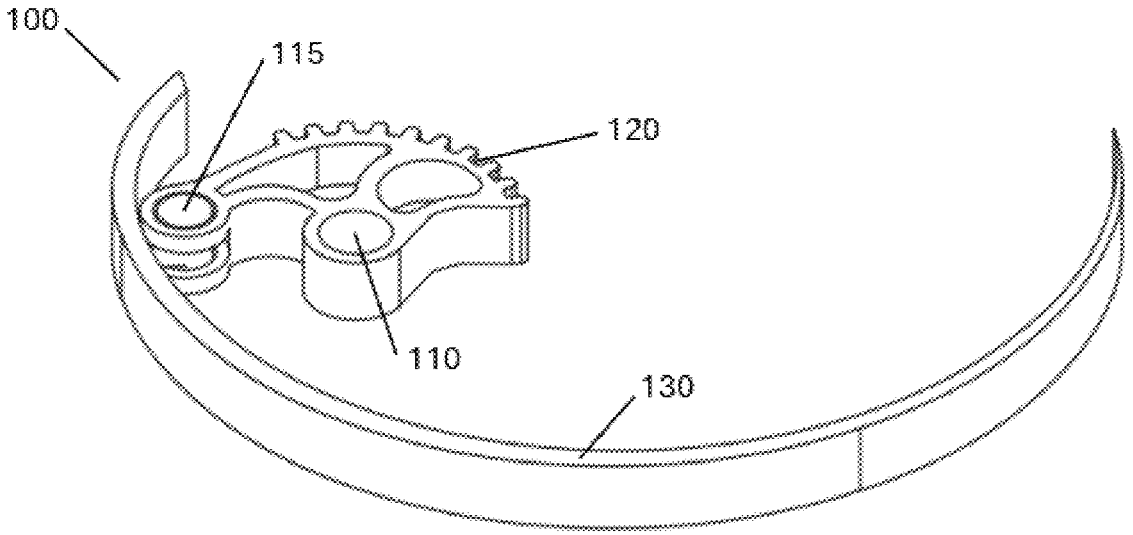
FIG. 2 is a perspective view of the actuator subassembly (100) of FIG. 1 pivoted and flexed in its maximum extended position.
Figure 3:
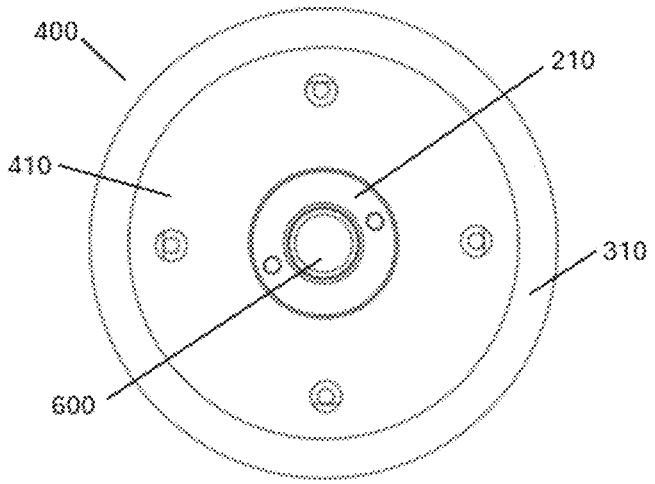
FIG. 3 is a top plan view of a mechanism housing (400) including an upper housing plate (410) and showing a deformable ring (310) in a neutral state. A central support member (600), which defines an axis of rotation for a central actuator (210) and may define a through-passage, is visible.
Figure 4:
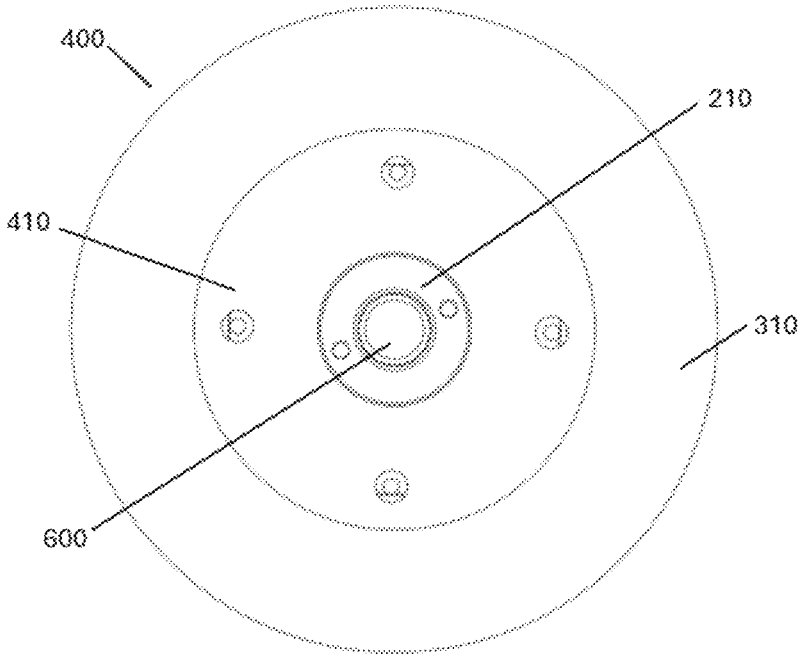
FIG. 4 is a top plan view showing the mechanism housing (400) including the upper housing plate (410) with the deformable ring (310) in a maximum extended state. The central support member (600), which defines the axis of rotation for the central actuator (210) and may define a through-passage, is visible.
Figure 5:
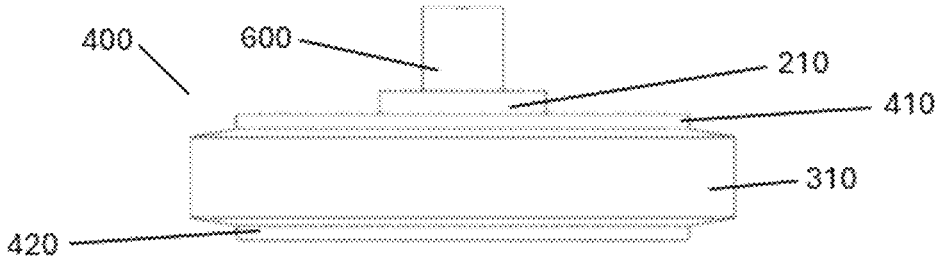
FIG. 5 is a front elevational view of the mechanism housing (400) including an upper housing plate (410) and a lower housing plate (420) and showing the deformable ring (310) in the neutral state.
Figure 6:
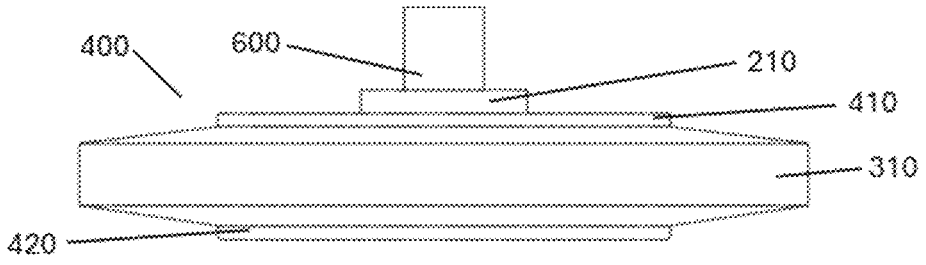
FIG. 6 is a front elevational view with the mechanism housing (400) including the upper housing plate (410) and the lower housing plate (420) and the deformable ring (310) in the maximum expanded state.
Figure 7:
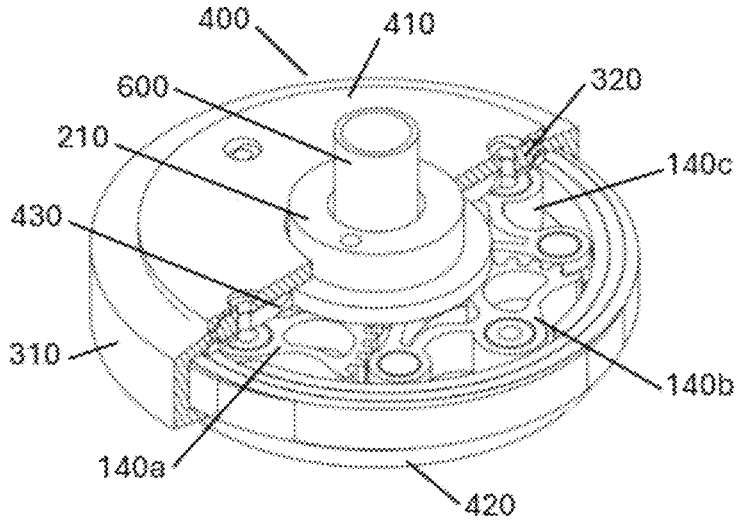
FIG. 7 is a perspective, partially sectioned view of the mechanism in which the deformable ring (310), an upper housing plate (410), an upper mechanism plate (430), and a lower housing plate (420) are shown, and the mechanism is sectioned through a central plane so that three of the actuator subassemblies (140*a*-140*c*) are visible in their neutral state. A fourth actuator subassembly (140*d*) is present but not visible in this sectional view. The central support member (600), which defines the axis of rotation for the central actuator (210) and may define a through-passage, is visible.
Figure 8:
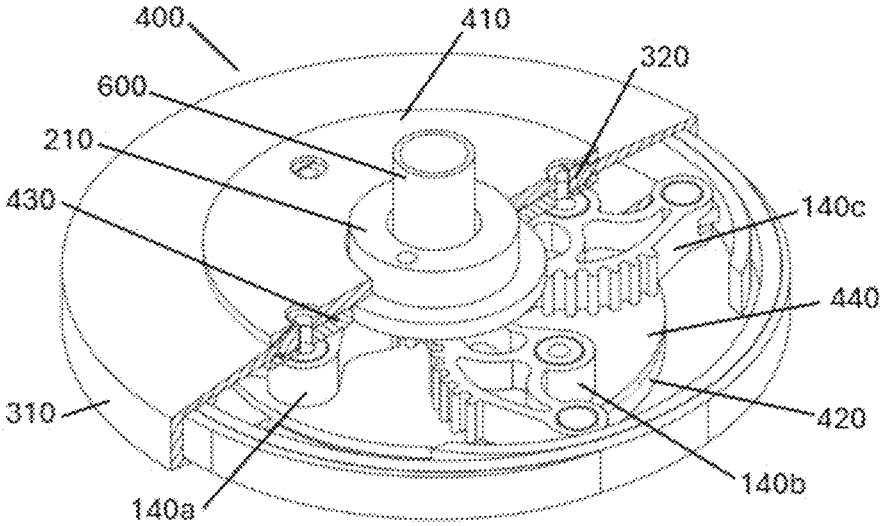
FIG. 8 is a perspective, partially sectioned view similar to FIG. 7, showing an upper housing plate (410), an upper mechanism plate (430), a lower mechanism plate (440), and a lower housing plate (420), with the deformable ring (310) and the plates sectioned so that three of the actuator subassemblies (140*a*-140*c*) are visible in their expanded state. A fourth actuator subassembly (140*d*) is present but not visible in this sectional view. The central support member (600), which defines the axis of rotation for the central actuator (210) and may define a through-passage, is visible.

Reference is now made to FIGS. 1-11, in which like reference numerals designate like elements throughout the several views.

General Structure

A mechanism assembly (200) is supported within a housing (400) that defines an annular cavity concentric about a central axis. In the illustrated embodiments, the housing (400) includes an upper housing plate (410) and a lower housing plate (420). The mechanism assembly (200) includes a central actuator (210), a plurality of actuator subassemblies (140*a*-140*d*), a deformable ring (310) disposed around the actuator subassemblies, and one or more mechanism plates including an upper mechanism plate (430) and a lower mechanism plate (440).

The central actuator (210) is preferably a spur gear that is operatively coupled to a user-operable dial or rotary input. The central actuator (210) is centered on a central support member (600), which extends along the axis of the mechanism, defines the axis of rotation for the central actuator (210), and may define a through-passage for liquid or another medium, for example where the mechanism is integrated into a drinking-vessel lid. In the illustrated embodiment, the central support member (600) is attached to and supported by the lower housing plate (420).

Circumferentially disposed around the central actuator (210) are the actuator subassemblies (140*a*-140*d*). Each actuator subassembly (100) includes a toothed sector (120) meshed with the central actuator (210), a main pivot (110) that anchors the toothed sector (120) to the mechanism structure, and a curved arm (130) linked to the toothed sector (120) through a secondary pivot (115). In one embodiment, the main pivots (110) for the actuator subassemblies (140*a*-140*d*) are formed on, or supported by, the lower mechanism plate (440), which in turn is supported relative to the lower housing plate (420).

A deformable ring (310) is seated within a circumferential channel (320) adjacent distal ends of the curved arms (130). The channel (320) is defined at least in part between the upper housing plate (410) and the upper mechanism plate (430) on an upper side of the deformable ring (310) and between the lower mechanism plate (440) and the lower housing plate (420) on a lower side of the deformable ring (310). The upper housing plate (410) and the upper mechanism plate (430) cooperate to compress an inner portion of the deformable ring (310) into the channel (320) from above, and the lower mechanism plate (440) and the lower housing plate (420) cooperate to compress an inner portion of the deformable ring (310) into the channel (320) from below. This arrangement secures the deformable ring (310) in place and helps prevent the deformable ring (310) from separating from the mechanism under forces generated during radial expansion and contraction.

In a neutral state, as shown for example in FIGS. 3, 5, 7, and 10, the curved arms (130) are positioned such that the deformable ring (310) defines a base or minimum effective outer diameter. In an expanded state, as shown for example in FIGS. 2, 4, 6, 8, 9, and 10, rotation of the central actuator (210) causes the curved arms (130) to move radially outward and increase the effective outer diameter of the deformable ring (310).

Figure 11:
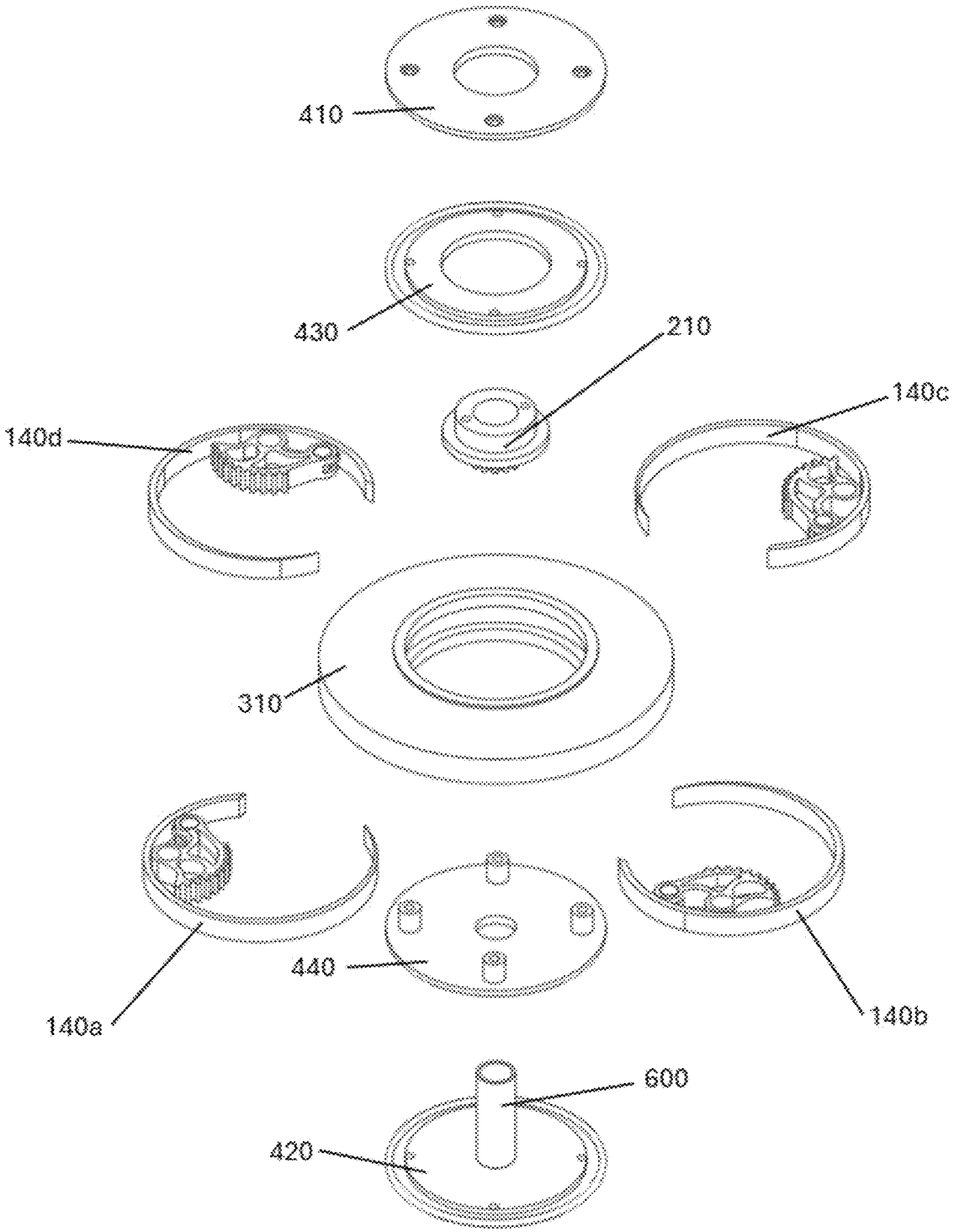
FIG. 11 is an exploded perspective view showing the upper housing plate (410) and lower housing plate (420), the upper mechanism plate (430), the lower mechanism plate (440), the central actuator (210), the actuator subassemblies (140*a*-140*d*), the deformable ring (310), and the central support member (600).

FIG. 11 illustrates an exploded perspective view of the mechanism assembly (200). In this view, the relative positions of the upper housing plate (410), lower housing plate (420), upper mechanism plate (430), lower mechanism plate (440), central actuator (210), actuator subassemblies (140*a*-140*d*), deformable ring (310), channel (320), and central support member (600) are shown separated along the axis of the mechanism to clarify the assembly relationship of the components.

The housing (400) and the mechanism plates (430, 440) thus enclose and support the central actuator (210), the actuator subassemblies (140*a*-140*d*), and the deformable ring (310) while allowing the central support member (600) to extend along the axis and, where desired, provide the through-passage for fluid flow.

Figure 9:
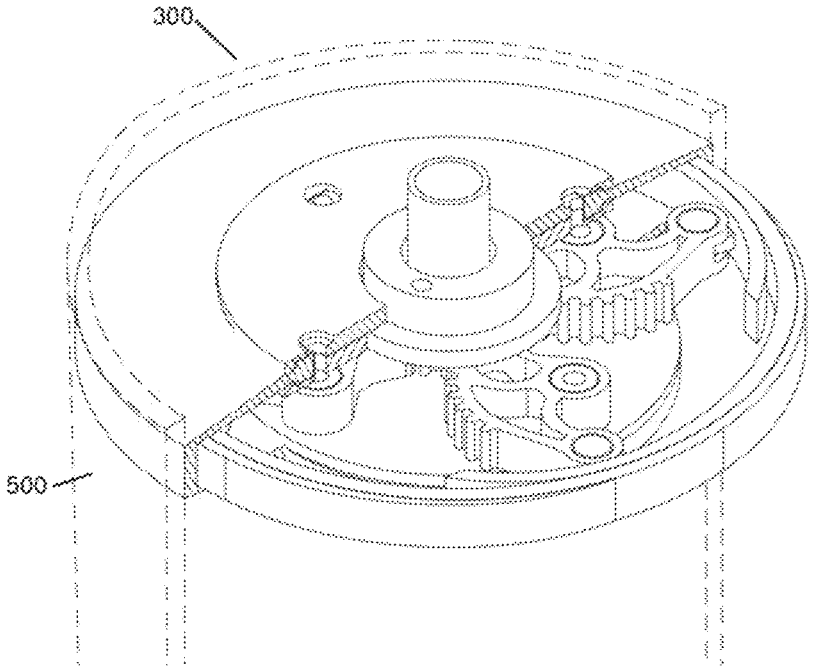
FIG. 9 is a perspective, partially sectioned view further showing the mechanism fitted into a vessel (500) in an installed configuration (300).
Figure 10:
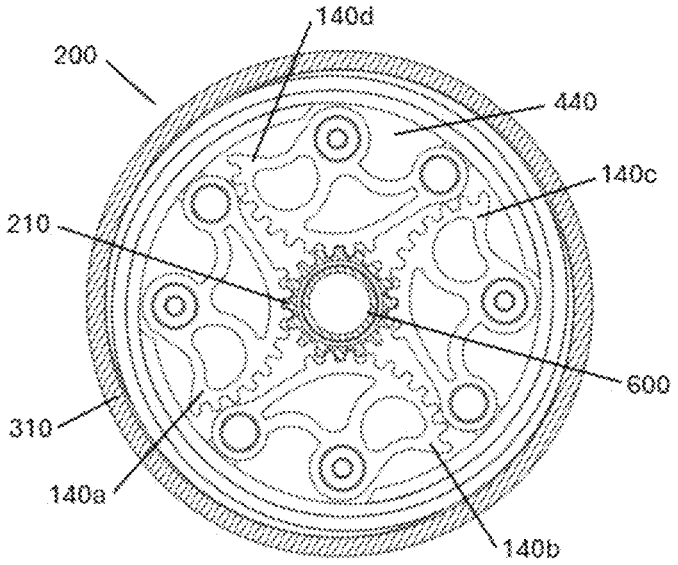
FIG. 10 is a radial sectioned view of the mechanism fully exposing the actuator subassemblies (140*a*-140*d*), a lower mechanism plate (440), the central actuator (210), and the deformable ring (310) in section.

In an installed configuration (300), illustrated for example in FIG. 9, the mechanism assembly (200) is positioned within a vessel (500) such that radial expansion of the deformable ring (310) causes uniform contact with an inner wall of the vessel (500), thereby establishing a seal over a range of vessel diameters.

Operation

When the user rotates the dial or other input operatively coupled to the central actuator (210), the central actuator (210) transmits motion to the toothed sectors (120) of the actuator subassemblies (140*a*-140*d*). Each toothed sector (120) rotates about its main pivot (110), which in turn causes the attached curved arm (130) to swing radially outward about the secondary pivot (115).

Distal ends of the curved arms (130) press against the deformable ring (310) seated within the circumferential channel (320). This coordinated movement expands the deformable ring (310) uniformly to engage an interior surface of the vessel (500) or another surrounding structure. Reverse rotation of the central actuator (210) returns the actuator subassemblies (140*a*-140*d*) and the deformable ring (310) to their neutral positions, reducing the effective outer diameter of the deformable ring (310). The cooperation of the upper housing plate (410), upper mechanism plate (430), lower mechanism plate (440), and lower housing plate (420) with the channel (320) retains the deformable ring (310) during these movements.

In certain embodiments, the mechanism further includes a portion of the housing, lid, or another stationary structure that is configured to be grasped by a user to resist rotation of the mechanism or vessel while the user rotates the dial or other actuator interface. For example, a flange, handle, grip surface, or other projection may be formed integrally with the housing (400) or an associated lid structure and sized and shaped to be held by a user's fingers so that torque applied to the dial or actuator interface results in rotation of the central actuator (210) rather than rotation of the entire mechanism or vessel. The specific shape and configuration of this graspable portion may vary and may be adapted to the form factor of the vessel or lid in which the mechanism is installed.

The mechanism may include one or more locking features that allow it to remain fixed at any point along its range of expansion. Such locking may be achieved through detents, frictional interfaces, ratcheting elements, or functionally equivalent mechanical means integrated into the central actuator (210), the housing (400), or the user-operable dial. These features can maintain a desired sealing pressure without continuous user input Materials and Manufacture The deformable ring (310) is formed of a flexible, food-safe material such as silicone or thermoplastic elastomer. Structural elements including the housing (400), upper housing plate (410), lower housing plate (420), upper mechanism plate (430), lower mechanism plate (440), curved arms (130), and toothed sectors (120) of the actuator subassemblies (140*a*-140*d*), as well as the central actuator (210) and the central support member (600), are preferably molded or formed from durable, food-safe plastics such as polypropylene, acetal, or polycarbonate. Metallic or reinforced variants may be used for industrial implementations where higher loads or temperatures are expected.

Components may be manufactured via injection molding, precision machining, or a combination thereof. The design of the actuator subassemblies (140*a*-140*d*), the mechanism plates (430, 440), and the housing (400) lends itself to repeatable, high-volume production. The relative dimensions, heights, and thicknesses of the curved arms (130), toothed sectors (120), housing plates (410, 420), mechanism plates (430, 440), deformable ring (310), and other components may be varied, and the mechanism may be scaled for different vessel sizes or vertical profiles, without departing from the spirit and scope of the invention.

Advantages

The mechanism provides uniform circumferential pressure for consistent sealing across a range of vessel diameters. It allows reversible actuation without relying solely on elastic stretching of the deformable ring (310), thereby reducing elastic fatigue and enhancing service life.

Because the deformable ring (310) is driven mechanically through pivoting subassemblies rather than by simple compression from above or below, sealing pressure can be controlled and distributed around the full circumference. The use of the upper housing plate (410), lower housing plate (420), and mechanism plates (430, 440) to define the channel (320) and clamp the deformable ring (310) helps maintain secure retention of the deformable ring (310) even under repeated expansion and contraction. The same underlying mechanism can be scaled to different diameter ranges, for example approximately 50-110 mm for typical consumer tumblers, or other ranges for industrial applications.

Applications

While optimized for use in a universal-fit premium tumbler lid, the mechanism is not limited to such lids. The mechanism can be integrated into food-storage containers, laboratory vessels, and industrial couplings that require reliable, adjustable-diameter sealing. It may be used with manual actuation or coupled to powered rotational drives in automated systems.

What is claimed is:

1. An adaptive sealing mechanism comprising:

a central actuator configured to translate rotational motion into radial displacement;

a plurality of actuator subassemblies arranged circumferentially around the central actuator, each actuator subassembly including a toothed sector and a curved arm linked by a secondary pivot and supported for rotation about a main pivot;

a deformable ring disposed around the actuator subassemblies and engaged by distal ends of the curved arms; and wherein rotation of the central actuator causes the actuator subassemblies to move outward to increase an effective outer diameter of the deformable ring and press the deformable ring against an interior surface of a vessel to form a seal, and reverse rotation of the central actuator allows the deformable ring to return toward a neutral diameter.

2. The adaptive sealing mechanism of claim 1, wherein the central actuator comprises a spur gear and each toothed sector comprises a gear segment meshed with the spur gear.

3. The adaptive sealing mechanism of claim 1, wherein the central actuator is supported on a central support member that defines a through-passage for liquid or a drinking straw.

4. The adaptive sealing mechanism of claim 1, wherein the plurality of actuator subassemblies comprises four actuator subassemblies spaced substantially evenly around the central actuator.

5. The adaptive sealing mechanism of claim 1, wherein the deformable ring is seated within a circumferential channel defined at least in part between an upper housing plate and an upper mechanism plate on an upper side of the deformable ring and between a lower mechanism plate and a lower housing plate on a lower side of the deformable ring.

6. The adaptive sealing mechanism of claim 5, wherein the upper housing plate and the upper mechanism plate cooperate to compress an inner portion of the deformable ring into the channel from above, and the lower mechanism plate and the lower housing plate cooperate to compress an inner portion of the deformable ring into the channel from below to retain the deformable ring during radial expansion and contraction.

7. The adaptive sealing mechanism of claim 1, wherein the main pivots of the actuator subassemblies are formed on or supported by a lower mechanism plate, and the lower mechanism plate is supported relative to a lower housing plate that supports a central support member on which the central actuator is centered.

8. The adaptive sealing mechanism of claim 1, wherein the mechanism is configured for use with vessels having an interior diameter within a range of approximately 50 millimeters to 110 millimeters.

9. The adaptive sealing mechanism of claim 1, wherein the mechanism is configured such that a maximum expanded effective outer diameter of the deformable ring is approximately 30 percent to 40 percent greater than a neutral effective outer diameter of the deformable ring.

10. The adaptive sealing mechanism of claim 1, further comprising a user-operable dial or rotary control coupled to the central actuator to allow manual adjustment of the effective outer diameter of the deformable ring.

11. The adaptive sealing mechanism of claim 10, wherein the user-operable dial or rotary control is integrated into an upper lid portion of a drinking-vessel closure.

12. The adaptive sealing mechanism of claim 1, further comprising at least one locking feature configured to maintain the actuator subassemblies at a selected radial position corresponding to a selected effective outer diameter of the deformable ring.

13. The adaptive sealing mechanism of claim 12, wherein the at least one locking feature comprises at least one of a detent, a frictional interface, or a ratcheting element associated with the central actuator or the housing.

14. The adaptive sealing mechanism of claim 1, wherein the deformable ring comprises a food-safe elastomeric material selected from silicone and thermoplastic elastomer, and at least one of the central actuator, housing plates, and mechanism plates comprises a food-safe thermoplastic material selected from polypropylene, acetal, and polycarbonate.

15. The adaptive sealing mechanism of claim 1, wherein the housing forms at least a portion of a universal-fit tumbler lid configured to be removably attached to a beverage tumbler, and the vessel comprises the beverage tumbler.

16. The adaptive sealing mechanism of claim 10, further comprising a portion of the housing, lid, or another stationary structure configured to be grasped by a user to resist rotation of the mechanism or the vessel while the user rotates the user-operable dial or rotary control.

* * * * *